US005890648A

United States Patent [19]

Cai

[11] Patent Number: 5,890,648

[45] Date of Patent: Apr. 6, 1999

[54] CARTON WITH SAUCE HOLDER

[75] Inventor: Liming Cai, West Chester, Pa.

[73] Assignee: Dopaco, Inc., Exton, Pa.

[21] Appl. No.: 16,803

[22] Filed: Jan. 30, 1998

[51] Int. Cl.[6] ..... B65D 5/487; B65D 5/66

[52] U.S. Cl. ..... 229/120.05; 229/120.08; 229/148; 229/902; 229/904

[58] Field of Search ..... 229/120.05, 120.08, 229/121, 146, 148, 165, 902, 904, 906

[56] References Cited

U.S. PATENT DOCUMENTS

| | | | |
|---|---|---|---|
| 3,352,053 | 11/1967 | Anderson | 229/120.08 |
| 3,404,829 | 10/1968 | Stone | 229/148 |
| 4,431,128 | 2/1984 | Dirico | 229/904 |
| 4,694,987 | 9/1987 | Forbes, Jr. . | |
| 4,778,055 | 10/1988 | Kiedaisch | 229/120.08 |
| 4,895,259 | 1/1990 | Paley | 229/904 |
| 5,520,324 | 5/1996 | Cai . | |
| 5,553,772 | 9/1996 | Jensen | 229/148 |
| 5,575,420 | 11/1996 | Whitnell | 229/906 |
| 5,605,279 | 2/1997 | Adamek | 229/906 |

FOREIGN PATENT DOCUMENTS

| | | | |
|---|---|---|---|
| 508205 | 12/1954 | Canada | 229/904 |
| 2275044 | 8/1994 | United Kingdom | 229/120.05 |

*Primary Examiner*—Gary E. Elkins
*Attorney, Agent, or Firm*—Dennison, Meserole, Pollack & Scheiner

[57] ABSTRACT

The tray of the carton is divided into larger and smaller compartments by a transverse intermediate wall. The tray outer end wall at the smaller compartment is integrally formed with a lid panel folded to overlie the smaller compartment and extend laterally outward of opposed side walls of the tray. The intermediate wall is integral with and depends from the lid panel. A cover, with depending side walls, is integrally hinged to the second end wall of the tray with the cover side walls including forwardly extending lugs engagable with and beneath the transversely extending portions of the lid panel to releasably lock the cover in a closed position.

13 Claims, 3 Drawing Sheets

CARTON WITH SAUCE HOLDER

BACKGROUND OF THE INVENTION

Folded paperboard containers, normally disposable, are used in a wide variety of configurations in the fast food industry.

The present invention is concerned with cartons of the type utilized in the accommodation of two separated foodstuffs, and more particularly a food product and a sauce which is to be added to the food product, or in which the food product is to be dipped, at such time as the food product is to be consumed.

It is quite common for sauce cups to be supplied as a separate item from the carton or package for the principal food product. However, as a matter of convenience and security, it is preferred that specific provision be made for the accommodation of such a sauce cup in the actual packaging of the principal product.

A package for such purposes, will be noted in the patent to Paley U.S. Pat. No. 4,895,259, issued Jan. 23, 1990.

A similar although more complex carton will be noted in the patent to Forbes, Jr., U.S. Pat. No. 4,694,987, issued Sep. 22, 1987, which indicates that an opening 26 may be included for "specialized products". No further explanation is given as to the purpose of this opening.

Inasmuch as such cartons are normally single-use items and used by the thousands, any improvements which can be made in reducing the cost associated with such cartons can be quite significant. Savings can reside in a reduction in the amount of raw material required, simplified construction, reduced assembly procedures, and the like. Such improvements, either individually or in combination, must also continue to maintain the primary function of such packages in protectively accommodating foodstuffs, preferably with improved features such as enhanced stability.

SUMMARY OF THE INVENTION

The carton of the invention is specifically intended for the accommodation, in a single base tray, of two separated foodstuffs, particularly a food product and a sauce or syrup preferably contained within a conventional sauce cup.

The carton is to be formed from a unitary blank of foldable material, normally paperboard, to provide a highly stable two-compartment covered tray for the accommodation of a full complement of a food product and a separately secured sauce cup. The carton does so in a manner which substantially reduces the amount of board material, as for example compared to Forbes, Jr., and substantially reduces both assembly procedures and manipulation steps involved in the closing of the carton subsequent to introduction of the food product, as well as the opening of the food product compartment for access thereto.

The advantages of the invention are achieved by a carton which is folded from a single planar blank to include an elongate tray divided by an intermediate transverse wall into a first enlarged compartment with a pivoted cover and a second smaller compartment. Both compartments are defined by selected tray walls and the intermediate wall. A substantially planar single lid or closure panel overlies the smaller compartment, and extends laterally beyond the opposed side walls of the tray and directly engages thereon. The cover of the larger compartment includes depending side walls which extend into forwardly projecting lugs selectively engagable beneath the laterally projected opposed portions of the lid panel providing for a positive although releasable locking of the cover. The lid panel itself is integral with the intermediate wall which depends therefrom and is locked to the bottom or bottom panel of the base tray.

The lid or closure panel of the smaller compartment has no side walls, and sits directly on the opposed upper edges of the tray side walls well below the top panel of the cover, avoiding any interference with the cover during the selective closing and opening thereof. A central aperture is formed in the lid panel to receive an appropriate cup for sauce, syrup or the like in accord with the food product in the larger or main compartment. It is contemplated that the upper end of the sauce cup will normally be at or slightly above the lid panel for ready access thereto as the food product is taken from the open larger compartment.

The stability of the smaller compartment, and more particularly the lid panel thereof is enhanced by providing that the intermediate wall extend perpendicularly between the lid panel and the tray bottom, thus providing effective resistance to excess or disruptive flexing of the carton as the sauce cup or the like is pushed into frictional engagement within the sauce cup opening. Further, inasmuch as the smaller sauce cup accommodating compartment would not normally be open, a positive lock is provided between the intermediate wall and the tray bottom preventing a release thereof without a positive manual manipulation.

Other features of the invention are considered to reside in the details thereof, and will become more apparent as the invention is more fully described hereinafter.

DESCRIPTION OF PREFERRED EMBODIMENT

Figure 1:
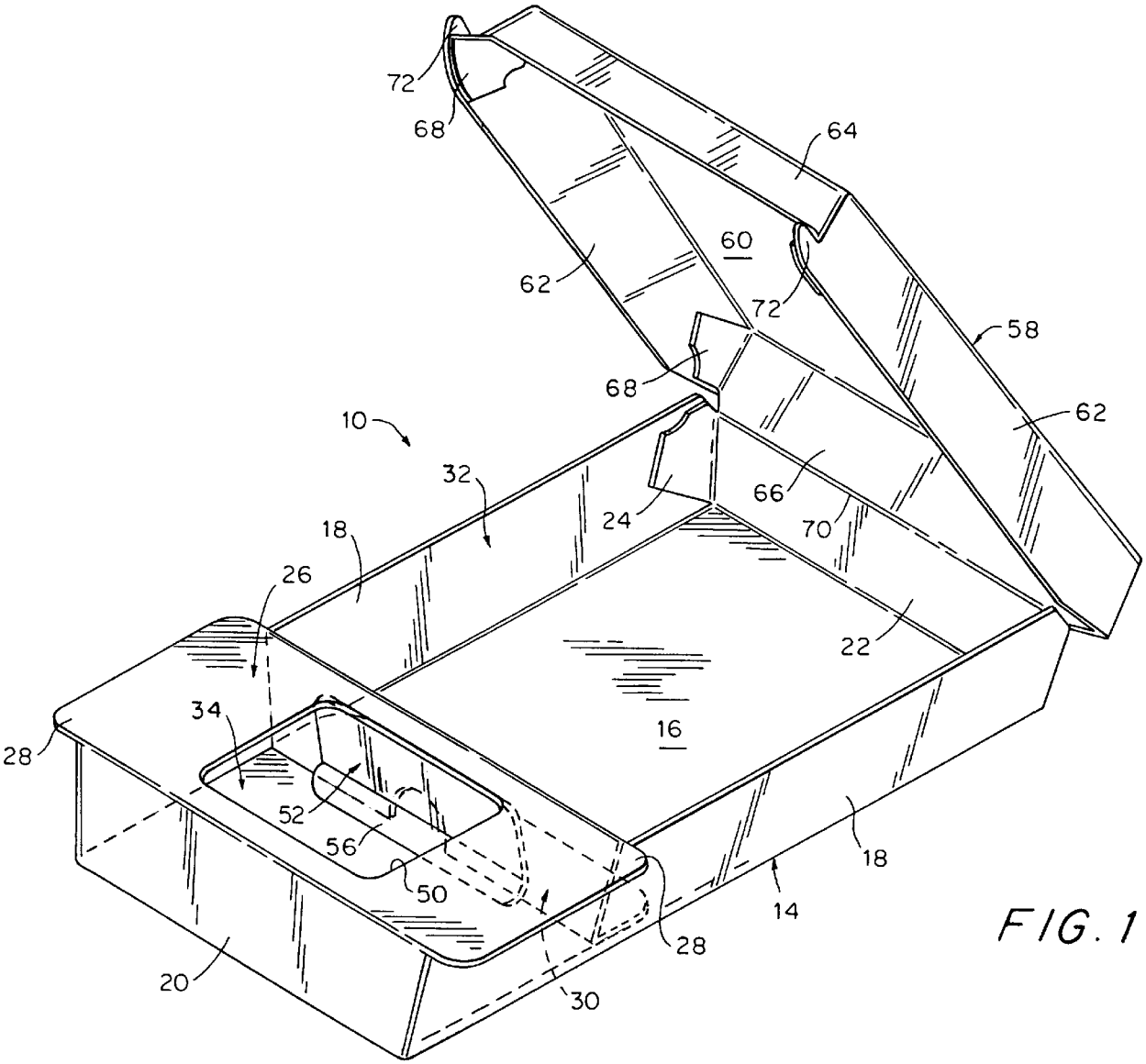
FIG. 1 is a top perspective view of the carton of the invention with the cover pivoted to an open position.
Figure 2:
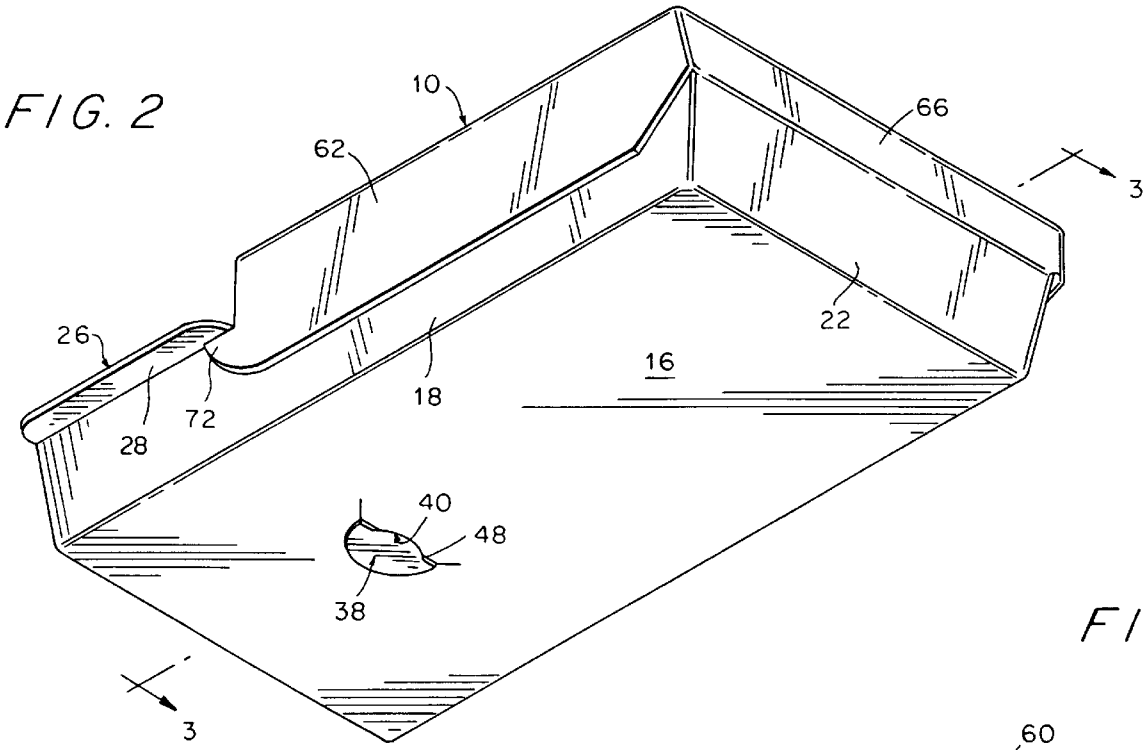
FIG. 2 is a bottom perspective view of the closed carton.
Figure 3:
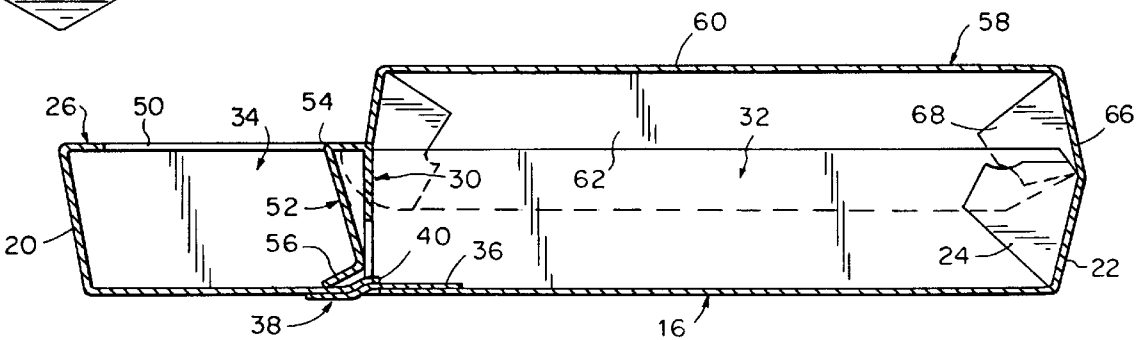
FIG. 3 is a longitudinal cross-sectional view taken substantially on a plane passing along line 3—3 in FIG. 2.

Referring now more specifically to the drawings, the carton 10 is formed from a unitary blank 12 of paperboard or a like foldable shape-sustaining material. The formed carton includes an elongate tray 14 having a rectangular bottom or bottom panel 16 with opposed side walls 18 integral with and folded upward from the opposed elongate side edges of the bottom 16, and closed end walls 20 and 22 integral with and folded upward from the opposed ends or end edges of the bottom 16. The walls 18, 20 and 22 incline slightly outward as they extend upward from the bottom 16, and are joined at sealed corners formed by end adhesive flaps 24 integral with and folded from the end walls 20 and 22 and adhesively bonded to the adjoining end portions of the side walls 18. Tray side walls 18 and end wall 20 are of equal height with substantially co-planar upper edges. The tray end wall 21 is of slightly less height.

A planar lid panel 26 is integrally formed with and folded from the upper edge of the end wall 20 into overlying relation with the adjoining portion of the tray 14 and in seating engagement with the upper edges of the tray side walls 18. The opposed transverse end portions 28 of lid panel 26 are co-planar with the main body of the planar lid panel 26 and extend transversely beyond and outward of the opposed tray side walls 18 to provide minor overhanging portions.

A transversely extending intermediate wall 30 is integrally formed with and folded downward from the inner edge of the lid panel 26, this intermediate wall 30 being of substantially equal height with the tray side walls and extending perpendicular to both the lid panel 26 and the tray bottom 16 into engagement with the tray bottom 16. The tray 14 is thus divided into a first larger compartment 32 and a second smaller compartment 34.

A substantially full-length flange 36 is integral with and laterally turned from the lower edge of the intermediate wall 30 to extend into the larger compartment 32 and overlie the tray bottom 16 as a stabilization means for the intermediate wall 30. In order to lock the intermediate wall in position, a locking tab 38 is defined from the central lower portion of the intermediate wall 30 by appropriate cut lines and remains integral with the flange 36 and substantially co-planar therewith to extend to the opposite side of the intermediate wall 30 as the flange folds to extend into the larger compartment 32. Thus, with the flange 36 laterally folded, the tab 38 will extend to the opposite side of the intermediate wall 30 toward the smaller compartment 34.

The actual locking is achieved by the extension of the tab 38 downward through a corresponding locking slot 40 cut through the tray bottom 16 directly beneath the intermediate wall 30. The tab 38 is formed with a rounded head portion 42 outwardly spaced from the lower edge of the intermediate wall 30 and hence the flange 36, by a narrow neck portion 44 which in turn defines a pair of locking shoulders 46 directed inward toward the intermediate wall and flange. The slot 40 includes an arcuate center portion of a length greater than the transverse width of the tab neck portion 44 and less than the transverse width of the head portion 42 at the shoulders 46. To the opposite side of the slot central portion, the slot end portions are reversely arced and define a pair of locking lugs or projections 48 extending toward the smaller formed compartment 34.

The overall length of the slot 40 readily accommodates the locking tab 38 therethrough. As the tab 38 moves through the slot 40, the locking lugs 48 will initially flex to allow passage of the tab head 42. After the tab head 42 has passed completely through the slot, the lugs or projections 48 will tend to move back to the plane of the tray bottom 16 and will engage behind the tab shoulders 46 with the tab shoulders and the immediately adjoined portions of the enlarged head 42 overlapping and underlying the lugs 48 to provide for a positive locking of the intermediate wall 30 and lid panel 26 in position. So assembled, accidental release of the intermediate wall is not possible. In fact, release, other than by a destruction of the carton, can only be achieved by a rather awkward manual grasping of the tab and a forcing of the tab in a reverse direction through the slot. Thus, it is readily apparent that the smaller compartment 34 is, throughout the period of use of the carton 10, to remain in its formed and lidded condition.

The compartment 34 is specifically provided to accommodate a sauce or the like provided in a standard sauce cup (not illustrated). Accordingly, the lid panel 26 is provided with a central aperture 50 formed therein and therethrough, and of a size so as to snugly receive sauce cups of the desired configurations. While the opening 50 can be formed by a complete removal of a central panel 52 from the lid panel 26, this panel 52 may be retained along a single fold line 54 parallel to and closely adjacent the intermediate wall 30. Thus, the panel 52 will fold downwardly into the compartment 34 and angle toward the intermediate wall 30 with the lower edge portion 56 laterally turned toward the interior of the compartment 34 at the tray bottom 16. So formed, the panel 52 will act as a supplemental retention means for an inserted sauce cup. In other words, the panel 52 can, in normal use, be downwardly folded into position by the insertion of the sauce cup itself. As such, there will be a tendency for this panel 52 to resiliently engage against and frictionally retain the inserted sauce cup. This in turn will allow for some reasonable variation in the size of the sauce cup. In other words, a relatively smaller sauce cup will tend to be biased against the side of the opening opposed from the resiliently flexed panel 52.

Turning now to the larger compartment 32, this compartment is provided with a cover 58 forming, with the underlying compartment portion of the tray 14, a container of the type generally referred to as a clam-shell container.

The cover 58 includes a top panel 60 generally conforming in configuration and size to that portion of the tray bottom 16 within the larger compartment 32. Integral full length side walls 62 depend and slightly diverge outward relative to each other from the top panel 60. Transversely extending end walls 64 and 66 depend from the opposed end edges of the top panel 60 and diverge slightly outward relative to each other. These end walls 64 and 66 include integral adhesive flaps 68 which are folded to overlie the adjacent end portions of the cover side walls 62 and are bonded thereto.

The lower edge of the cover outer wall 66 is integral with the tray end wall 22 with a hinge or fold line 70 provided therebetween. These walls 22 and 66 are of substantially equal height and slightly shorter than the tray side walls 18. The transverse inner end wall 64 of the cover 58 is in turn shorter than the outer wall 66 and, with the cover closed, engages with the upper edge of the intermediate wall 30 or with the upper edges of the tray side walls 18 immediately adjacent the intermediate wall 30 to provide for a substantially complete closing of the larger compartment 32 with the top panel 60 of the cover paralleling the tray bottom 16.

In order to complete the sealing and releasable locking of the cover 58 in its closed position, the opposed side walls 62 of the cover are of a greater height than the outer wall 66 and outwardly overlap the upper portions of the tray side walls 18, depending vertically therebelow and with the inner faces of the cover side walls 62 generally engaging the upper edge portions of the tray side walls 18 in the fully seated portion of the cover 58. The actual locking of the cover is provided for by a forwardly extending lug 72 integral and co-planar with each of the cover side walls 62 and extending forwardly beyond and below the cover front wall 64. These lugs 72, in the closed position of the cover, are snapped into position and engaged beneath the projecting transverse end portions 28 of the lid 26. This engagement is facilitated by a slight rounding of the bottom edges of the lugs 72 and the corresponding corners of the projecting portions 28, and by the inherent flexible resiliency of the paperboard. Once engaged, release of the cover is precluded until such time as the cover is positively manipulated. Basically, the cover 58 may be conveniently released by a slight rearward pressure on the cover, easily accommodated by the integrally joined end walls 22 and 66, and an upward pivoting of the cover about the integral hinge 70.

Upon an open pivoting of the cover 58, the food product within the larger compartment 32 is directly accessible for use in conjunction with sauce or the like retained within the smaller compartment 34 immediately adjacent thereto. The smaller sauce-receiving compartment 34 basically requires only the lid panel 26 and no side panels, the sauce cup being retained centrally within this compartment by engagement through and within the complimentary aperture 50. It is also to be appreciated that the lid provides multiple functions in addition to locating the aperture, including a protective enclosing of the sauce cup, the provision of laterally outwardly extending locking portions 28, support and stabilization of the intermediate wall 28, and a mounting of the retention assisting panel 52. With regard to the intermediate wall 30, it is to be appreciated that this wall extends perpendicularly between the lid panel 26 and the tray bottom 16 so as to provide maximum support for the lid panel 26 as a sauce cup is introduced thereto. Were this intermediate wall 30 to be inclined, there would be a greater tendency for the lid panel 26 to flex or fold in a manner which might disrupt the structure of the small compartment and interfere with the simple expedient of inserting the sauce cup. As a further enhancement to the stability of the erected carton, it will be noted that the locking tab 38 engages through the corresponding locking slot 40 in a direction toward the smaller compartment 34. Thus, the food product or products within the larger compartment 32 will tend to enhance this engagement and resist any tendency toward a retraction of the tab, thus supplementing to the engaged locking shoulders 46.

Figure 4:
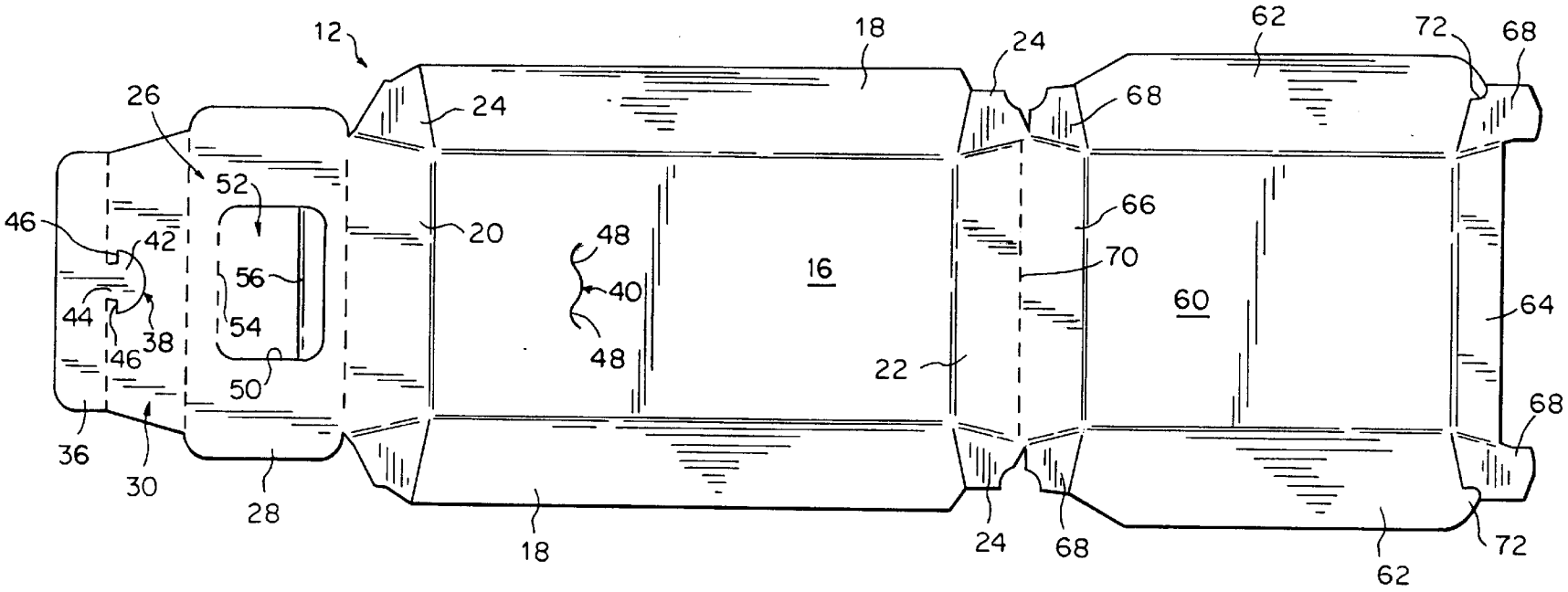
FIG. 4 is a plan view of the blank utilized in the formation of the carton.

FIG. 4 illustrates the blank 12 from which the carton 10 is folded. It is of interest to note that only eight glue or adhesive flaps 24, 68 are required and that provision is made for a releasable locking of the cover by the simple although unique expedient of slightly extending a portion of the cover side walls 62 by cutting into the adhesive flaps 68 to form the projecting locking lugs 72, and by slightly laterally extending the lid panel 26 in a co-planar manner beyond the opposed tray side walls 18 to define the extended locking portions 28. These extending portions 28 do not constitute side walls and are retained co-planar to the main portion of the lid panel 26 to effectively provide a locking component cooperative with the locking lugs 72.

In considering the blank, it will be noted that the various panels and other components thereof have been designated by the corresponding reference numerals referred to in the prior description of the carton.

The foregoing is illustrative of the features of the invention, and other embodiments as may fall within the scope of the claims following hereinafter, are also considered to be encompassed by the invention.

I claim:

1. A carton for the accommodation of first and second foodstuffs, said carton comprising a tray, said tray including a bottom with integral opposed elongate side walls extending upward therefrom, and integral opposed first and second end walls extending upward from said bottom transversely between said side walls, an intermediate wall extending transversely between said side walls at an intermediate position between said end walls, said intermediate wall extending upward from said tray bottom and defining first and second compartments to the opposite sides of said intermediate wall and between said intermediate wall and said first and second end walls respectively for the separated accommodation of foodstuffs; a cover for said first compartment, said cover having a top panel generally co-extensive with said first compartment, opposed side walls integral with said top panel and depending therefrom, and opposed inner and outer end walls integral with said top panel and depending therefrom transversely between said cover side walls, said cover outer end wall being integral with said tray first end wall along a hinge line wherein said cover is pivotally movable between a closed position overlying said first compartment with said cover inner wall substantially aligned with said tray intermediate wall, and an open position upwardly pivoted away from said first compartment; and a lid panel overlying said second compartment, said lid panel being substantially planar and having inner and outer edges respectively integral with said tray second end wall and said tray intermediate wall, said lid panel having co-planar opposed portions extending laterally outward beyond said opposed tray side walls, said cover side walls having longitudinally extending lugs overlapping the opposed extending portions of said lid panel transversely outward of said tray side walls and releasably snap-engaging therebeneath in the closed position of said cover.

2. The carton of claim 1 wherein said lid panel seats on said tray side walls and is partially supported thereby.

3. The carton of claim 2 wherein said intermediate wall extends perpendicular to said lid panel and said tray bottom and engages said tray bottom for direct support thereby.

4. The carton of claim 3 including an aperture defined centrally through said lid panel for the selective reception of a foodstuff therein.

5. The carton of claim 4 including a locking tab integral with said intermediate wall adjacent a lower edge thereof and laterally folded relative to said intermediate wall, said tray bottom having a slot defined therein and receiving said tab therethrough for a fixing of said intermediate wall to said bottom.

6. The carton of claim 5 wherein said locking tab is directed toward said second compartment and in underlying relation thereto, said intermediate wall having an integral flange folded therefrom and extending to the opposite side of said intermediate wall from said tab and into said first compartment in overlying relation to the bottom.

7. The carton of claim 6 wherein said tab includes an enlarged leading head with opposed shoulders inwardly directed toward said intermediate wall, said slot defining projections engaging said shoulders upon extension of said locking tab through said slot wherein withdrawal of the tab is precluded.

8. The carton of claim 7 including a retaining panel integral with said lid panel along an edge of said aperture, said retaining panel depending from said lid panel into said second compartment in general alignment with said aperture for selective engagement with foodstuff introduced through said aperture.

9. The carton of claim 2 including an aperture defined centrally through said lid panel for the selective reception of a foodstuff therein.

10. The carton of claim 9 including a locking tab integral with said intermediate wall adjacent a lower edge thereof and laterally folded relative to said intermediate wall, said tray bottom having a slot defined therein and receiving said tab therethrough for a fixing of said intermediate wall to said bottom.

11. The carton of claim 10 wherein said locking tab is directed toward said second compartment and in underlying relation thereto, said intermediate wall having an integral flange folded therefrom and extending to the opposite side of said intermediate wall from said tab and into said first compartment in overlying relation to the bottom.

12. The carton of claim 9 including a retaining panel integral with said lid panel along an edge of said aperture, said retaining panel depending from said lid panel into said second compartment in general alignment with said aperture for selective engagement with foodstuff introduced through said aperture.

13. For use in the formation of a folded carton, a longitudinally extending planar blank of foldable material, said blank comprising a cover top panel, longitudinally extending cover side walls integral with said top panel with fold lines defined therebetween, first and second cover end walls integral with said top panel with fold lines defined therebetween, an elongate tray bottom panel longitudinally aligned with said top panel, said bottom panel having opposed side walls integral with said bottom panel with fold lines therebetween, first and second transversely extending tray end walls integral with said bottom panel with fold lines therebetween, said first tray end wall being integral with said first cover end wall with a hinge line defined therebetween, a lid panel integral with said tray second end wall and foldable relative thereto, said lid panel being devoid of fold lines extending longitudinally on said blank, said lid panel having a transverse width greater than the transverse width of said bottom panel and less than the combined transverse width of said bottom panel and said tray side walls, said tray side walls and said tray second end wall being of equal height whereby said lid panel, in said carton, directly overlies and seats on said tray side walls with said lid panel extending transversely beyond said tray side walls in a single plane.

* * * * *